US011152682B2

(12) United States Patent
Pounds et al.

(10) Patent No.: US 11,152,682 B2
(45) Date of Patent: Oct. 19, 2021

(54) LOW-PIM UNIVERSAL ANTENNA EQUIPMENT MOUNT

(71) Applicant: ConcealFab Corporation, Colorado Springs, CO (US)

(72) Inventors: William Pounds, Colorado Springs, CO (US); Thomas Bell, Colorado Springs, CO (US); Steve Rogers, Colorado Springs, CO (US)

(73) Assignee: ConcealFab Corporation, Colorado Springs, CO (US)

( * ) Notice: Subject to any disclaimer, the term of this patent is extended or adjusted under 35 U.S.C. 154(b) by 250 days.

(21) Appl. No.: 16/599,647

(22) Filed: Oct. 11, 2019

(65) Prior Publication Data

US 2020/0119425 A1 Apr. 16, 2020

Related U.S. Application Data

(60) Provisional application No. 62/744,231, filed on Oct. 11, 2018.

(51) Int. Cl.
*H01Q 1/12* (2006.01)
*H01Q 1/24* (2006.01)

(52) U.S. Cl.
CPC ..... *H01Q 1/1228* (2013.01); *H01Q 1/246* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,794,897 | A | 8/1998 | Jobin et al. | |
| 6,354,543 | B1 | 3/2002 | Paske | |
| 6,899,305 | B2 | 3/2005 | Korczak et al. | |
| 8,439,316 | B2 | 5/2013 | Feige | |
| 10,253,906 | B2 | 4/2019 | Vaccaro | |
| 10,630,034 | B2 * | 4/2020 | Wankoff | H01Q 1/1228 |
| 10,734,719 | B1 * | 8/2020 | Bell | H01Q 1/52 |
| 2014/0315408 | A1 * | 10/2014 | Colapietro | H01R 13/46 439/247 |
| 2016/0064813 | A1 * | 3/2016 | Emerick | H01Q 1/48 343/841 |
| 2017/0025750 | A1 * | 1/2017 | Su | H01Q 1/36 |
| 2017/0025766 | A1 * | 1/2017 | Su | H01Q 9/42 |
| 2017/0141480 | A1 * | 5/2017 | Ng | H01Q 9/045 |
| 2019/0390797 | A1 * | 12/2019 | Bell | H02G 3/32 |

* cited by examiner

*Primary Examiner* — Junpeng Chen
(74) *Attorney, Agent, or Firm* — Mehrman Law Office; Michael J. Mehrman

(57) ABSTRACT

The present invention meets the needs described above through low-PIM universal antenna equipment mounts and associated assemblies for use at cell sites. The universal mounts are typically deployed in antenna equipment assemblies located in the nearfield reactive region behind the base station antennas. The mounts suppress PIM generation as compared to conventional equipment mounts even though the universal mounts are located well outside the main beam of the base station antenna. An illustrative universal mount includes a pressure bushing with a cap that includes a pair of parallel rails to stabilize the bushing on a metal mast. The rails allow the pressure bushing to transfer the load of the supported equipment to the curved surface of round cylindrical masts irrespective of the pipe diameter within the typical range of mast diameters, such as 2 inches to 6 inches in diameter.

20 Claims, 8 Drawing Sheets

LOW-PIM UNIVERSAL ANTENNA EQUIPMENT MOUNT

REFERENCE TO RELATED APPLICATION

This application claims priority to U.S. Provisional Patent Application Ser. No. 62/744,231 filed Oct. 11, 2018, which is incorporated by reference.

TECHNICAL FIELD

The present invention is directed to cellular communication systems and, more particularly, to a low-PIM universal equipment mount used to eliminate loose metal-to-metal connections in antenna mounting configurations to reduce passive intermodulation interference (PIM) at cellular telephone base station antenna sites.

BACKGROUND

An essential element of modern mobile communications systems is the cellular telephone base station, also known as a "cell site." The cell site includes one or more directional base station antennas aimed at a desired geographical area of coverage with coaxial cables connecting the antennas to base station radio equipment. The performance of a cell site is often limited by passive intermodulation (PIM) interference. PIM interference occurs when the high-power downlink signals transmitted by the base station antennas mix at passive, non-linear junctions in the RF path, creating new signals known as intermodulation products. When these intermodulation products fall in an operator's uplink band, they act as interference and reduce the SINR (signal to interference plus noise ratio). As the SINR is reduced, the geographic coverage and data capacity of the cell site is reduced.

It is well documented that loosely touching metal-to-metal surfaces can behave in a non-linear fashion and become sources of PIM interference when illuminated by high power RF (radio frequency) signals. Recently, it has been determined that loose metal-to-metal connections located behind base station antennas are also able to generate high levels of PIM interference. Even though this region is well outside the main beam of the antenna, enough RF energy is present in this region to excite non-linear junctions and generate PIM interference. Based on field measurements it has been determined that loose metal-to-metal contacts located very close to base station antennas (within 1 wavelength of the carrier frequency) are more likely to generate high levels of PIM interference than loose metal-to-metal contacts located farther away (greater than 1 wavelength) from base station antennas.

A common source of loose metal-to-metal contact found in the reactive nearfield region behind and close to base station antennas is metal brackets and associated hardware for supporting ancillary equipment such as radios, filters, tower mounted amplifiers, coaxial cables and the antennas themselves to the antenna mounting pipe. In many cases, these items are secured to the antenna mounting pipe with brackets containing a notch at the pole interface and two holes on either side of the pole for insertion of threaded rods. The holes in the brackets must be spaced far enough apart to allow the threaded rods to be installed on antenna mounting pipes ranging from 2 inches to 6 inches in diameter. These brackets are often very large, heavy and expensive. Nuts, washers and lock washers are installed on the threaded rods and the nuts are torqued to generate clamping force on the antenna mounting pipe. Often, an additional "interface" bracket is installed between the brackets contacting the pole and the ancillary equipment.

If sufficient torque is not applied to the mounting hardware, PIM can be generated at the bracket to pipe interface as well as bracket-to-bracket interfaces. Due to the high clamping force required to secure these brackets, the brackets often break through the galvanized coating on the antenna mounting pipe creating areas of exposed steel. These exposed steel locations can become corroded or rusty over time creating sources of PIM. In addition, due to the large number of mounting brackets on a typical installation, the possibility exists for one bracket to loosely touch another, creating yet another source of PIM.

An improved low-PIM antenna mount is therefore needed to overcome the limitations of the existing alternatives.

SUMMARY

The present invention meets the needs described above through low-PIM universal antenna equipment mounts and associated assemblies for use at cell sites. The universal mounts are typically deployed in antenna equipment assemblies located in the nearfield reactive region behind the base station antennas. The mounts suppress PIM generation as compared to conventional equipment mounts even though the universal mounts are located well outside the main beam of the base station antenna. An illustrative mount includes a pressure bushing with a cap that includes a pair of parallel rails to stabilize the pressure bushing on the metal mast. The parallel rails allow the pressure bushing to transfer the load of the supported equipment to the curved surface of round cylindrical mast irrespective of the pipe diameter within the typical range of mast diameters, such as 2 inches to 6 inches in diameter.

BRIEF DESCRIPTION OF THE FIGURES

The numerous advantages of the embodiments of the invention may be better understood with reference to the accompanying figures.

DETAILED DESCRIPTION

Figure 1:
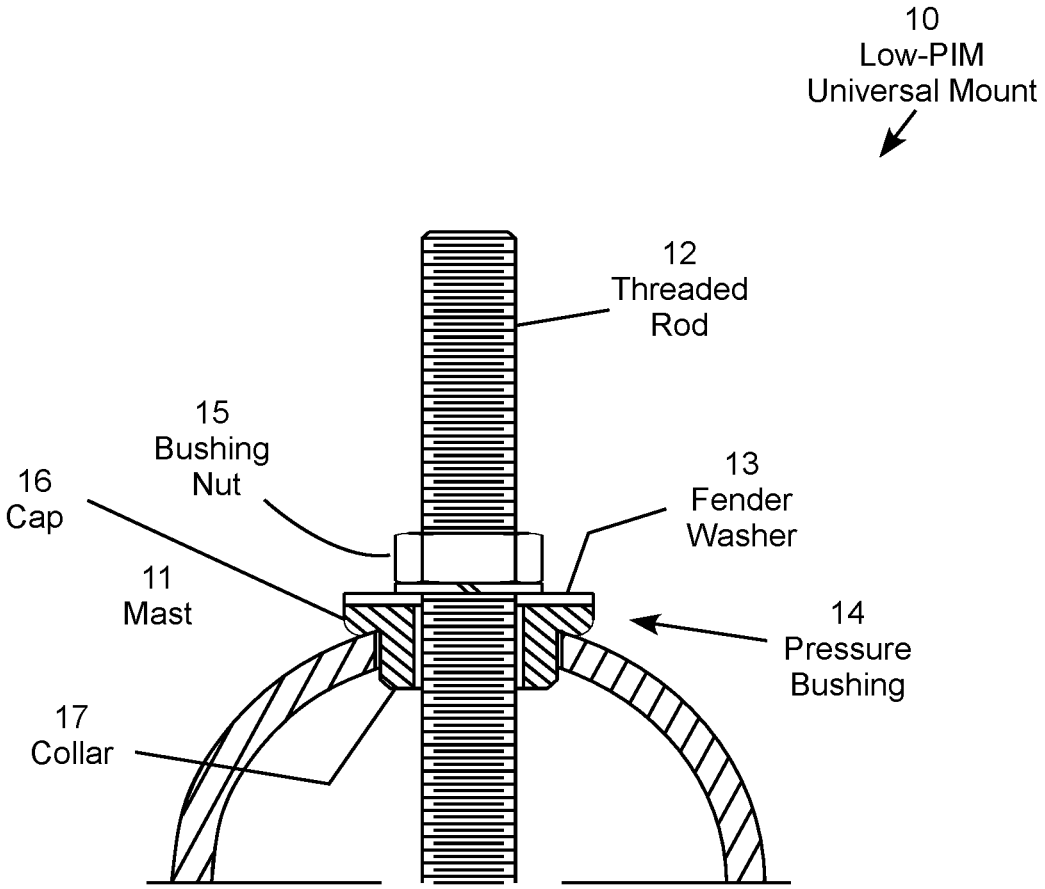
FIG. 1 is a sectional top view of a low-PIM universal mount.

Embodiments of the invention include a low-PIM universal antenna equipment mount and associated assemblies. These embodiments may be utilized in concert with other techniques to reduce PIM at cellular base stations, such as the low-PIM equipment described in commonly owned U.S.

patent application Ser. Nos. 16/450,925, 16/581,597, and 16/591,703, which are incorporated by reference.

The present invention meets the needs described above through low-PIM universal antenna equipment mounts ("universal mounts") and associated assemblies for use at cell sites. The universal mounts are typically deployed in antenna equipment assemblies located in the nearfield reactive region behind the base station antennas in a direction away from the main beam direction of the antenna. Deploying the universal mounts in the nearfield reactive region significantly reduces PIM generation as compared to conventional equipment mounts even though the universal mounts are located well outside the main beam of the base station antenna.

In an illustrative embodiment, the universal mount includes a length of round cylindrical galvanized steel or stainless steel pipe serving as a mast for mounting cellular communication equipment, such as antennas, radios, splitters, combiners, RF feedline cables, cable support systems, and related equipment. The universal mounts are used to attach a number of antenna brackets, platforms, accessory brackets, cable brackets and other types of equipment support members to the mast. The equipment support members, in turn, support the cellular communication equipment. The universal mounts provide low-PIM structural support to the mast capable of supporting the equipment and resisting environmental loads, such as ice, wind, and snow loads applied by the attached equipment.

In the illustrative embodiments, the mast includes a series of spaced holes aligned along the central axis of the mast. The holes for the universal mount are typically positioned along the neutral axis of the mast orthogonal to the main physical load supported by the mast. The universal mounts may also be aligned in pairs across the mast along the neutral axis to allow a bolt, threaded rod, or other type of fastener to pass horizontally through pressure bushings positioned in each hole. The holes are sized to receive the insulating collars of the low-PIM pressure bushings and fender washers to electrically isolate the mechanical hardware from the metal mast. The specific diameter and wall thickness of the mast (pipe) are determined by the mast's support system, the spacing of the mounting holes, and anticipated load conditions. The mast typically ranges from 2" to 6" in diameter with Schedule 40 to Schedule 80 wall thickness.

The pressure bushings may be manufactured from a polymeric material, such as injection molded plastic. For example, an illustrative embodiment of the pressure bushing may be glass-filled Nylon. In an alternative embodiment, the pressure bushing may be cast or machined aluminum. An aluminum pressure bushing is suitable for use with a galvanized steel mast when the attachment pressure on the pressure bushing is sufficiently high and the galvanic properties of the pressure bushing and mast materials are sufficiently close to each other to ensure that the connection will exhibit the desired low-PIM characteristic when the universal mount is located in the reactive nearfield region of an associated antenna. In particular, the connection pressure should be sufficiently high to prevent the pressure bushing from physically moving with respect to the mast under the expected mechanical load conditions. Other types of metal may be used for the pressure bushing provided that the connection exhibits the desired low-PIM characteristic when the mount is located in the reactive nearfield region of the associated antenna. A metal pressure bushing may be suitable for use with a bolt or threaded rod that is galvanized steel like the mast and brackets. With the polymeric bushing, the mast and brackets may be either galvanized or stainless hardware since the metals are insulated by the polymeric pressure bushing.

The universal mount is capable of resisting the loads applied by mechanical fasteners like bolts or threaded rods and nuts. The universal mounts may be deployed in pairs oppositely positioned with one pressure bushing on each side of the mast to provide concentric isolation for a pair of connected devices, such as oppositely pointed antennas. A polymeric pressure bushing maintains mechanical separation and electrical isolation between the metal mast and any metal fasteners to reduce PIM. A first representative pressure bushing has an inner diameter sized to accommodate ⅜ inch metal fasteners, while a second representative pressure bushing has an inner diameter sized to accommodate ½ inch metal fasteners. Additional pressure bushings may be sized to accommodate fasteners with other sizes, as required. For each size, the pressure bushing may be dyed, painted or otherwise coated with a different color for easy identification of the different sizes.

In an illustrative embodiment, the pressure bushing is shaped to provide a flat surface parallel to the central axis of the mast and perpendicular to the metal fastener attaching the pressure bushing to the mast. For example, the cap of the pressure bushing may include a pair of parallel rails to stabilize the pressure bushing on a metal mast. The rails allow the pressure bushing to transfer the load of the supported equipment to the curved surface of round cylindrical masts irrespective of the pipe diameter within the typical range of mast diameters, such as 2 inches to 6 inches in diameter.

In a particular assembly, the universal mount includes a multi-use platform made of galvanized or stainless steel. The universal mount is capable of withstanding the loads applied by the platform in addition to the brackets and associated ancillary equipment, such as antennas, radios, splitters, combiners, RF feedline cables, and RF feedline cable support systems, and so forth. The mast may have spaced mounting holes, each receiving a low-PIM pressure bushing, that attach multiple platforms, brackets or other supports to the mast. The dimensions of platform and brackets can be varied to fit properly onto differently sized masts.

The universal platform and other support members may include bends forming dimples at connection points to increase the rigidity of the connections. The reduced surface contact area at a dimple increases the contact pressure between at the connection point to suppress PIM generation. The platform typically incorporates a bolt hole located on the flat surface of each dimple. The holes on the dimples are sized to receive the hardware that fastens the support member to another equipment bracket or piece of equipment.

Equipment brackets are typically made of galvanized steel or stainless steel and are capable of withstanding the equipment and environmental loads applied by the attached equipment. A typical equipment bracket includes holes that are sized to receive mounting hardware to fasten the bracket to a support member, such as a mast or platform. The mounting holes may be positioned to align with the holes located in the dimpled areas of a support member.

It will be understood that specific embodiments may include a variety of features in different combinations, as desired by different users. The specific techniques and systems for implementing particular embodiments of the invention and accomplishing the associated advantages will become apparent from the following detailed description of the embodiments and the appended drawings and claims.

FIG. 1 is a sectional top view of a representative low-PIM universal mount 10 attached to a metal mast 11, which in this example is a vertically oriented, nominal 2-inch round schedule 40 pipe. A threaded rod 12, which in this example is a horizontally oriented, nominal ⅜ inch threaded rod with UNC 16 threads, passes through a fender washer 13 and a pressure bushing 14 that is received in a receptacle hole through the wall of the mast 11. A bushing nut 15 is tightened to secure the fender washer 13 and the pressure bushing 14 to the mast 11 with the threaded rod otherwise secured to the mast, for example by an opposing bolt head or nut. The pressure bushing 14 includes a cap 16 captured between the mast 11 and the fender washer 13 and a collar 17 that extends from the cap through the receptacle hole in the wall of the mast. The cap 16 acts as a spacer between the mast 11 and other metal equipment attached to the mast by way of the threaded rod 12 to provide a low-PIM interface. A wide range of platforms, brackets and other supports may be attached to the mast 11 using one or more of the universal mounts 10 to create low-PIM equipment support members within the reactive nearfield regions of one or antennas connected to or near the mast. While a vertical mast is depicted for the illustrative embodiment, other embodiments may include masts in other orientations. Similarly, while a round cylindrical mast (pipe) is depicted for the illustrative embodiment, other embodiments may include masts with other shapes.

Figure 2:
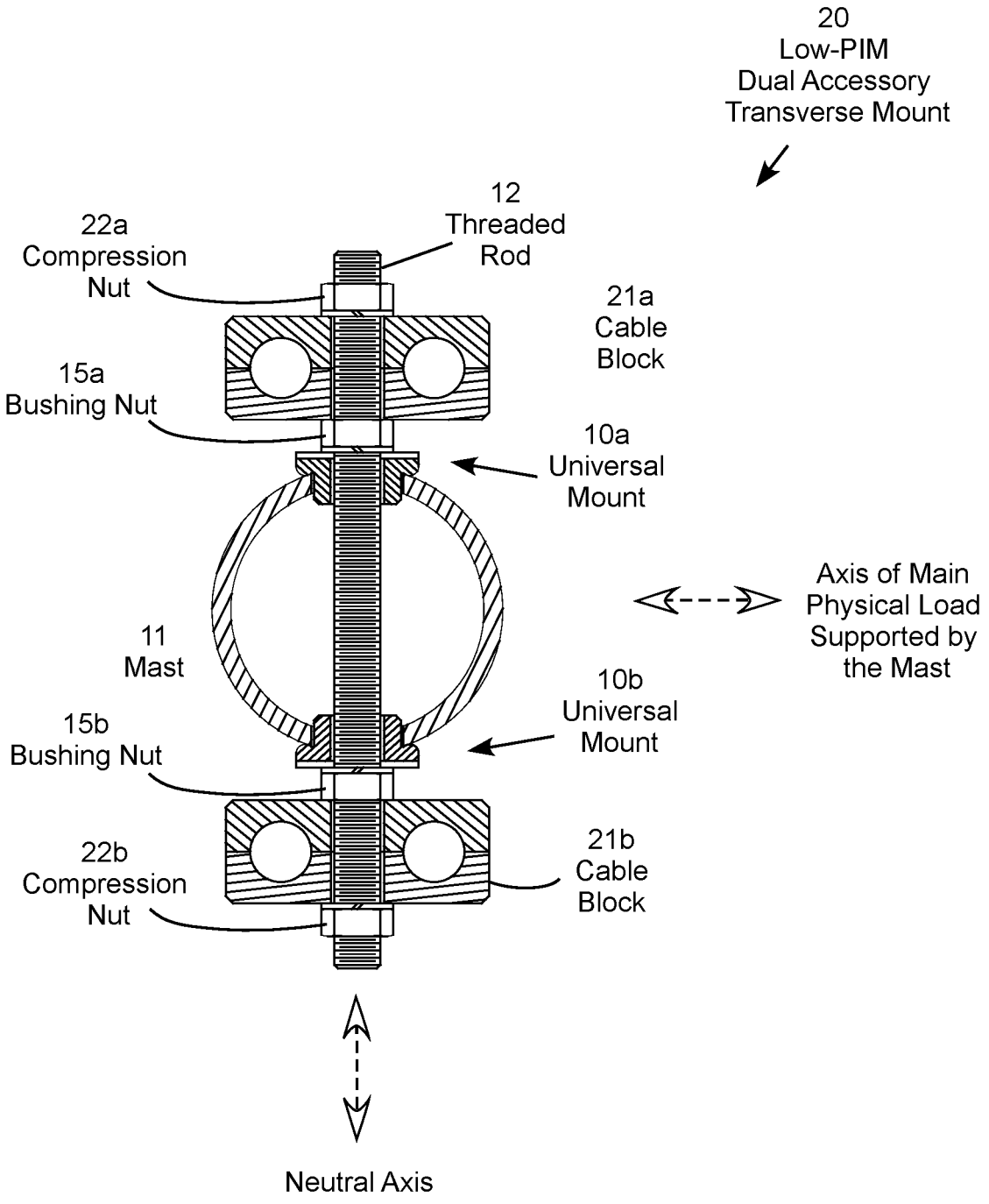
FIG. 2 is a sectional top view of a low-PIM dual accessory transverse mount utilizing two of the low-PIM universal mounts.

FIG. 2 is a sectional top view of a low-PIM dual accessory transverse mount 20 utilizing two of the low-PIM universal mounts 10*a* and 10*b*. In this example, the threaded rod 12 passes through the mast 11 to connect two cable blocks 21*a* and 21*b* to opposing sides of the mast. The cable block 21*a* is secured by a bushing nut 15*a* and a compression nut 22*a* on one side of the mast 11. Similarly, the cable block 21*b* is secured by a bushing nut 15*b* and a compression nut 22*b* on the opposing side of the mast 11. The threaded rod 12 passes through the mast 11 along the neutral axis, which is orthogonal to the axis of the main physical load supported by the mast to minimize the impact of the holes through the mast on the load carrying capability of the mast. For example, the cable block 21*a* and 21*b* are supported by a pair universal mounts 10*a* and 10*b* aligned along the neutral axis, while antennas and other heavier items are supported along the axis of the main physical load supported by the mast.

Figure 3:
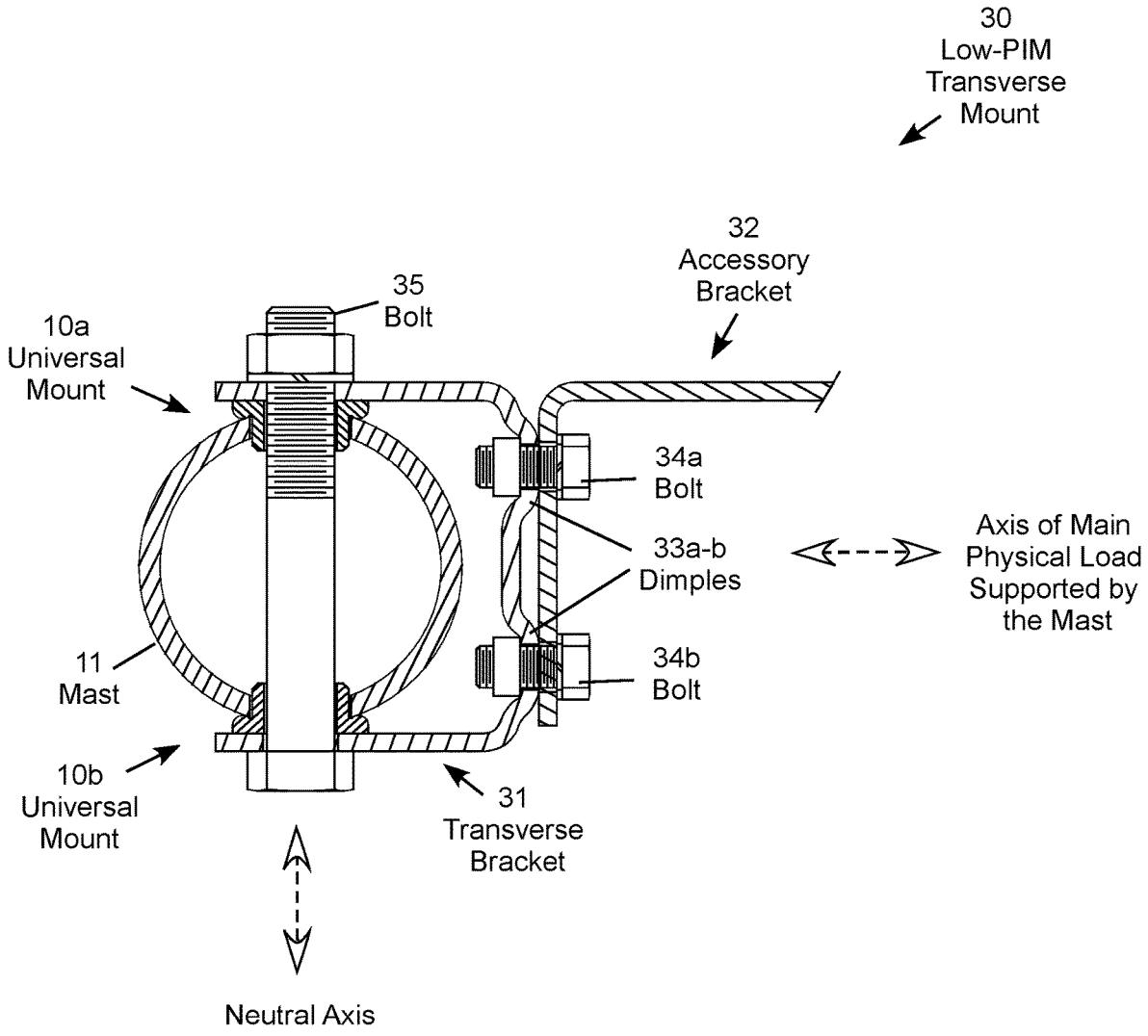
FIG. 3 is a sectional top view of a low-PIM transverse mount supporting a transverse bracket, which supports an accessory bracket.

FIG. 3 is a sectional top view of a low-PIM transverse mount 30 supporting a metal transverse bracket 31, which supports an accessory bracket 32. A pair of universal mounts 10*a* and 10*b* aligned along the neutral axis attach the metal transverse bracket 31 to the metal mast 11, which supports the accessory bracket 32 in the direction of the axis of the main physical load supported by the mast. The transverse bracket 31 includes dimples 33*a* and 33*b* to add rigidity where bolts 33*a* and 33*b* attach the transverse bracket 31 to the accessory bracket 32. Additional bolts may be utilized as desired, for example four bolts connecting the transverse bracket 31 to the accessory bracket 32. This particular example utilizes a bolt 35 to attach the transverse bracket 31 to the mast 11 while passing through pressure bushings to suppress PIM at the connection points.

Figure 4A:
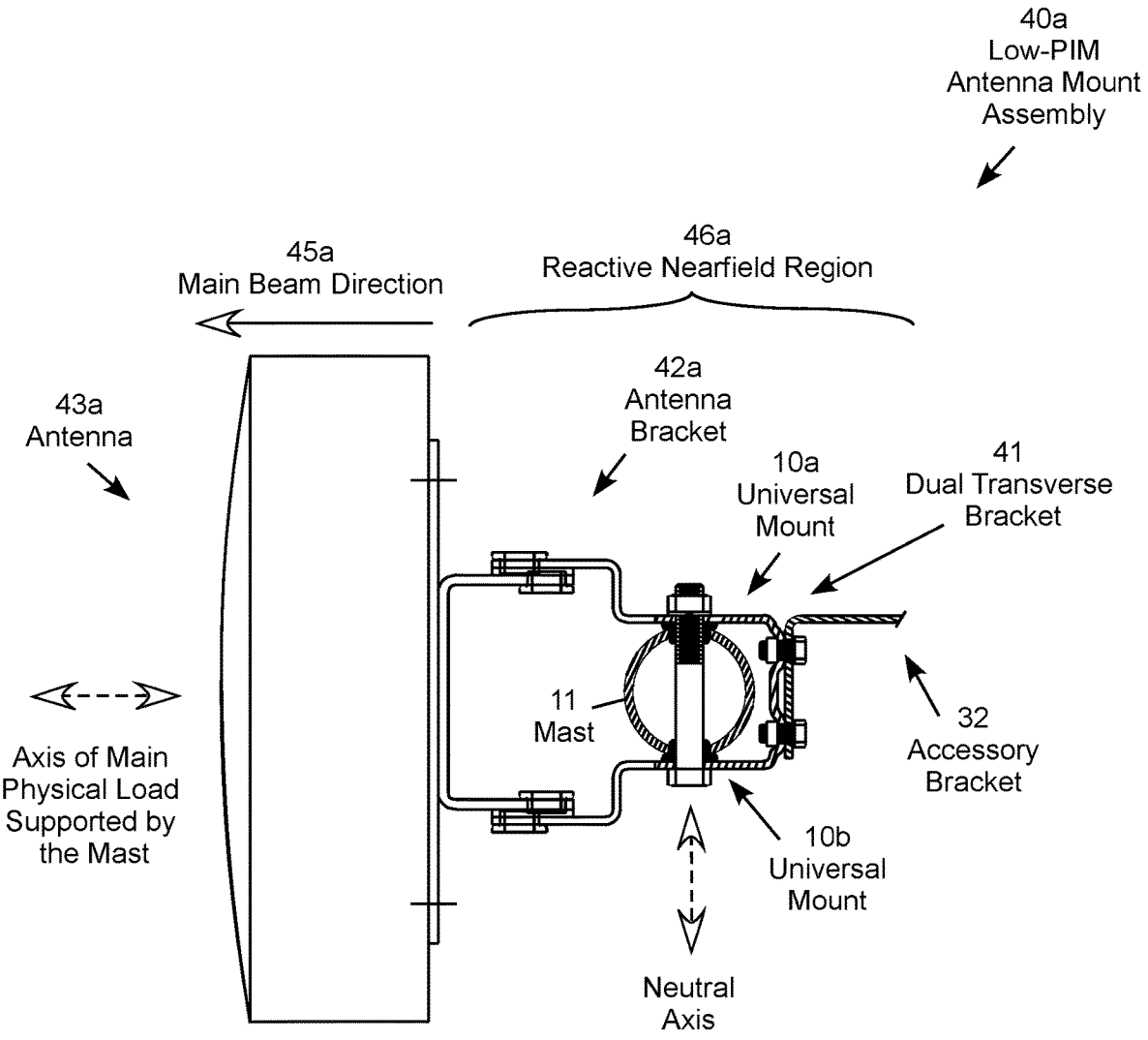
FIG. 4A is a top view of a low-PIM antenna mount assembly.

FIG. 4A is a top view of a low-PIM antenna mount assembly 40*a* that utilizes a metal dual transverse bracket 41 to attach an accessory bracket 32 on one side of the metal mast 11, while supporting an antenna bracket 42*a*, which supports an antenna 43*a*, on the opposing side of the mast. The main beam direction of the antenna 43*a* is away from the antenna side of the assembly, and the reactive nearfield region 46*a* is behind the antenna generally within about one wavelength of the carrier frequency of the signals broadcast and received by the antenna 43*a*. The low-PIM antenna mount assembly 40*a* utilizes a pair of universal mounts 10*a* and 10*b* aligned along the neutral axis of the mast 11 to attach the metal dual transverse bracket 41 to the metal mast to suppress PIM generation from the connection points located in the reactive nearfield region 46*a*.

Figure 4B:
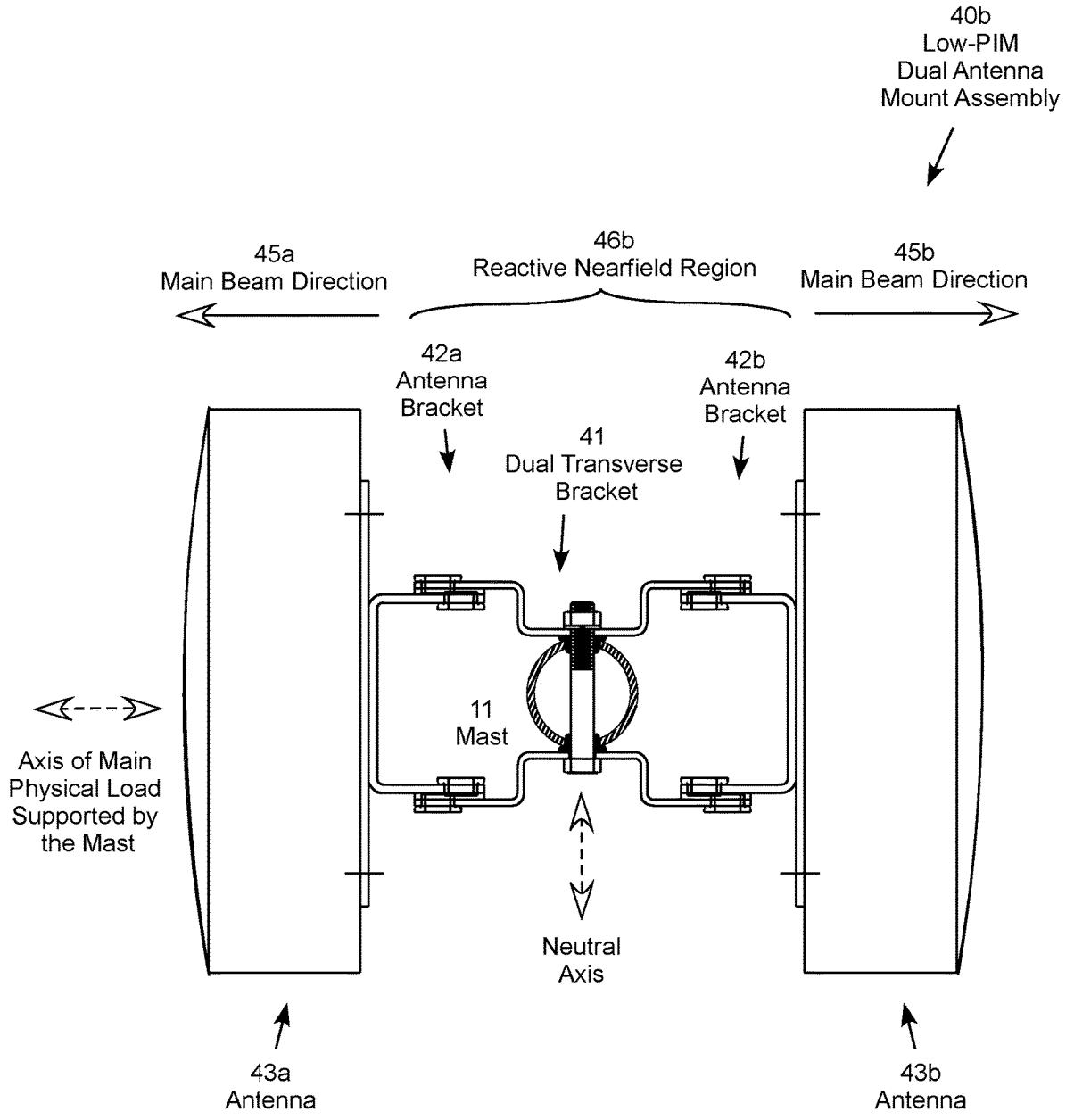
FIG. 4B is a top view of a low-PIM dual antenna mount assembly.

FIG. 4B is a top view of a low-PIM dual antenna mount assembly 40*b* in which the dual transverse bracket 41 supports two antennas 43*a* and 43*b* pointing in opposing directions. In this example, the dual transverse bracket 41 is located in the reactive nearfield region 46*a* of both antennas 43*a* and 43*b*. Again, the dual antenna mount assembly 40*b* utilizes a pair of universal mounts 10*a* and 10*b* aligned along the neutral axis of the mast 11 to attach the metal dual transverse bracket 41 to the metal mast to suppress PIM generation from the connection points located in the reactive nearfield region 46*b*.

Figure 5:
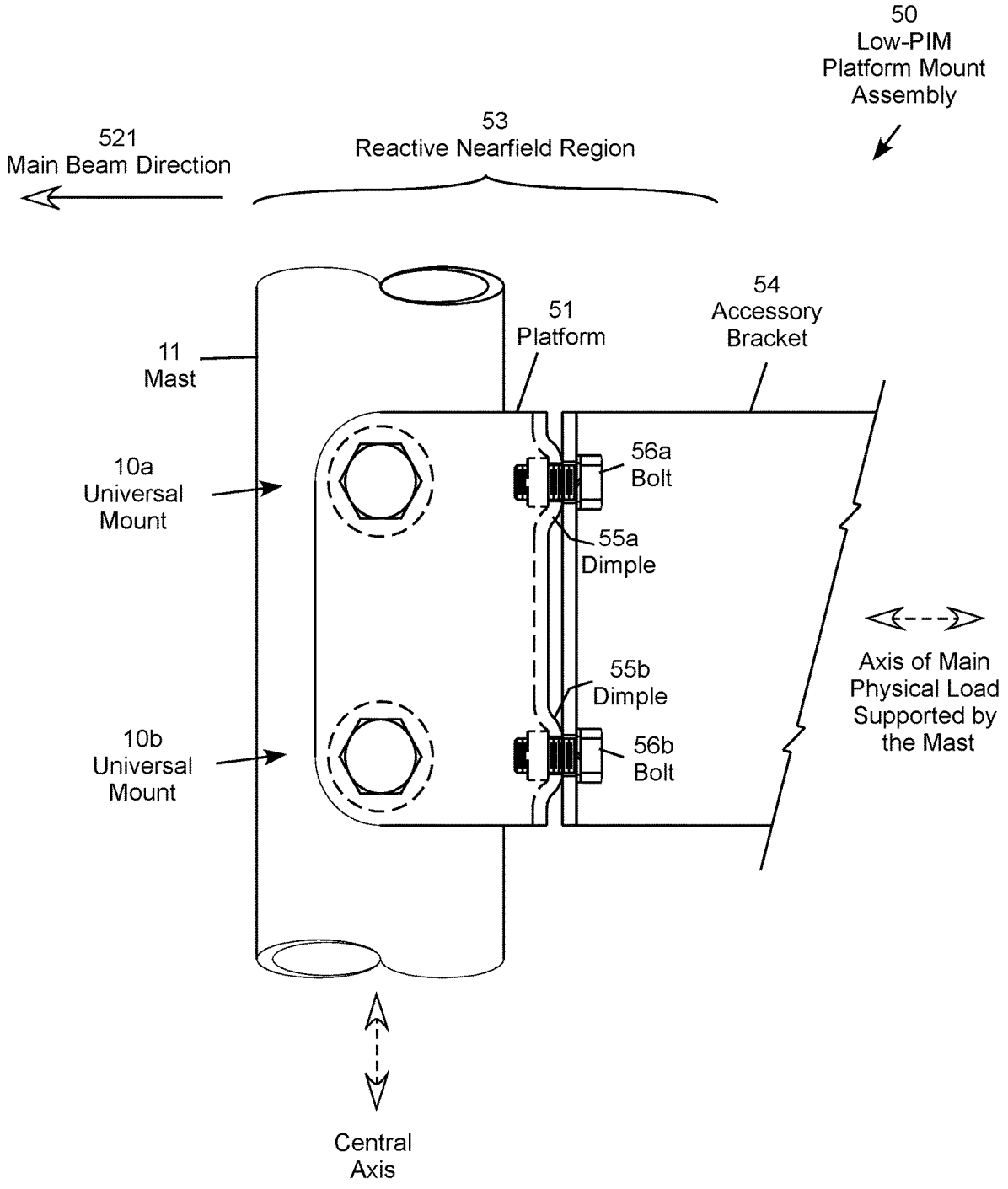
FIG. 5 is a side view of a low-PIM platform mount assembly.

FIG. 5 is a side view of a low-PIM platform mount assembly 50, which includes a metal platform 51 attached to a metal mast 11 by a pair of spaced low-PIM universal mounts 10*a* and 10*b* aligned along the central axis of the mast 11. The universal mounts 10*a* and 10*b* are also aligned along the neutral axis of the mast 11 orthogonal to the axis of the main physical load supported by the mast. The mast 11 is also positioned behind an antenna having a main beam direction 52 attached to or near the mast so that the universal mounts 10*a* and 10*b* are positioned in the reactive nearfield region 53 behind the antenna. The platform 51 supports an accessory bracket 54, which is attached to the platform at dimple 55*a* and 55*b* by bolts 56*a* and 56*b*, respectively. The dimples 55*a* and 55*b* add rigidity to the platform 51 at the attachment points of the accessory bracket 54, which can be used to support a range of communications equipment, such as antennas, radios, splitters, combiners, RF feedline cables, cable support systems, and so forth. The universal mounts 10*a* and 10*b* provide low-PIM supports between the metal mast 11 and the metal platform 51 capable of supporting the equipment and resisting environmental loads, such as ice, wind, and snow loads applied by the attached equipment.

Figure 6:
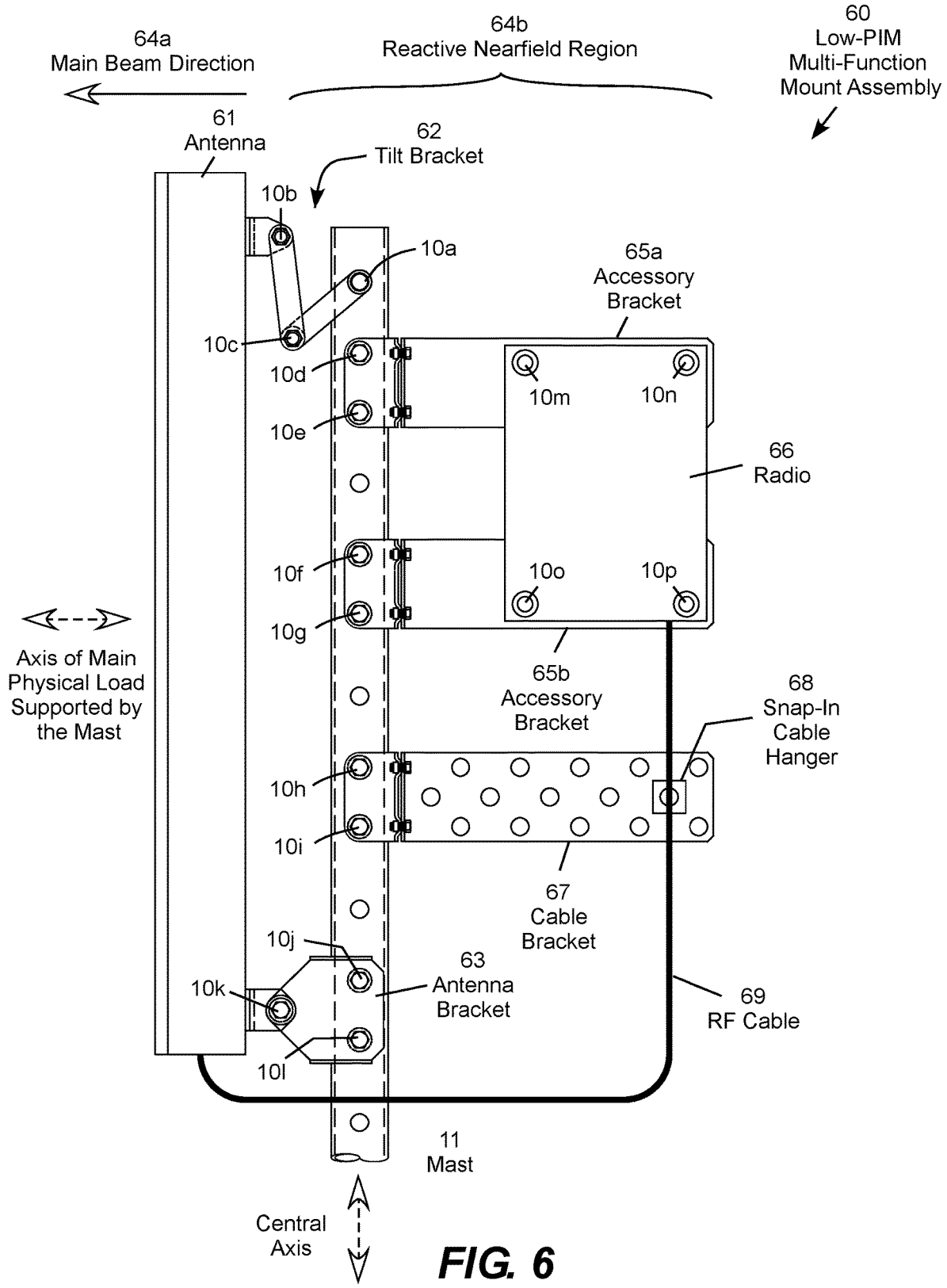
FIG. 6 is a side view of a low-PIM multi-function mount assembly.

To provide a more specific example, FIG. 6 is a side view of a low-PIM multi-function mount assembly 60, which includes an antenna 61 attached to a metal mast 11 by a metal tilt bracket 62 and a metal antenna bracket 63. The antenna 61 has a main beam direction 64*a* so that the tilt bracket 62 and the antenna bracket 63 are positioned in the reactive nearfield region 64*b* behind the antenna. The mast 11 also supports metal accessory brackets 65*a* and 65*b* that support a radio 66, and a metal cable support bracket 67 that supports a snap-in cable hanger 68. An RF cable 69 extends from the radio 66 through the snap-in cable hanger 68 and to the antenna 61. The metal tilt bracket 62, antenna bracket 63, accessory brackets 65*a* and 65*b*, and the cable bracket 67 are attached to the metal mast 11 by universal mounts 10*a* through 10*p* providing low-PIM supports between the mast and the attached brackets, and between certain brackets and attached equipment, capable of supporting the equipment and resisting environmental loads, such as ice, wind, and snow loads applied by the attached equipment. Additional low-PIM universal mounts may be utilized, for example at the junctions between platforms and brackets, at bracket-to-bracket junctions, and other potential source of PIM.

Figure 7:
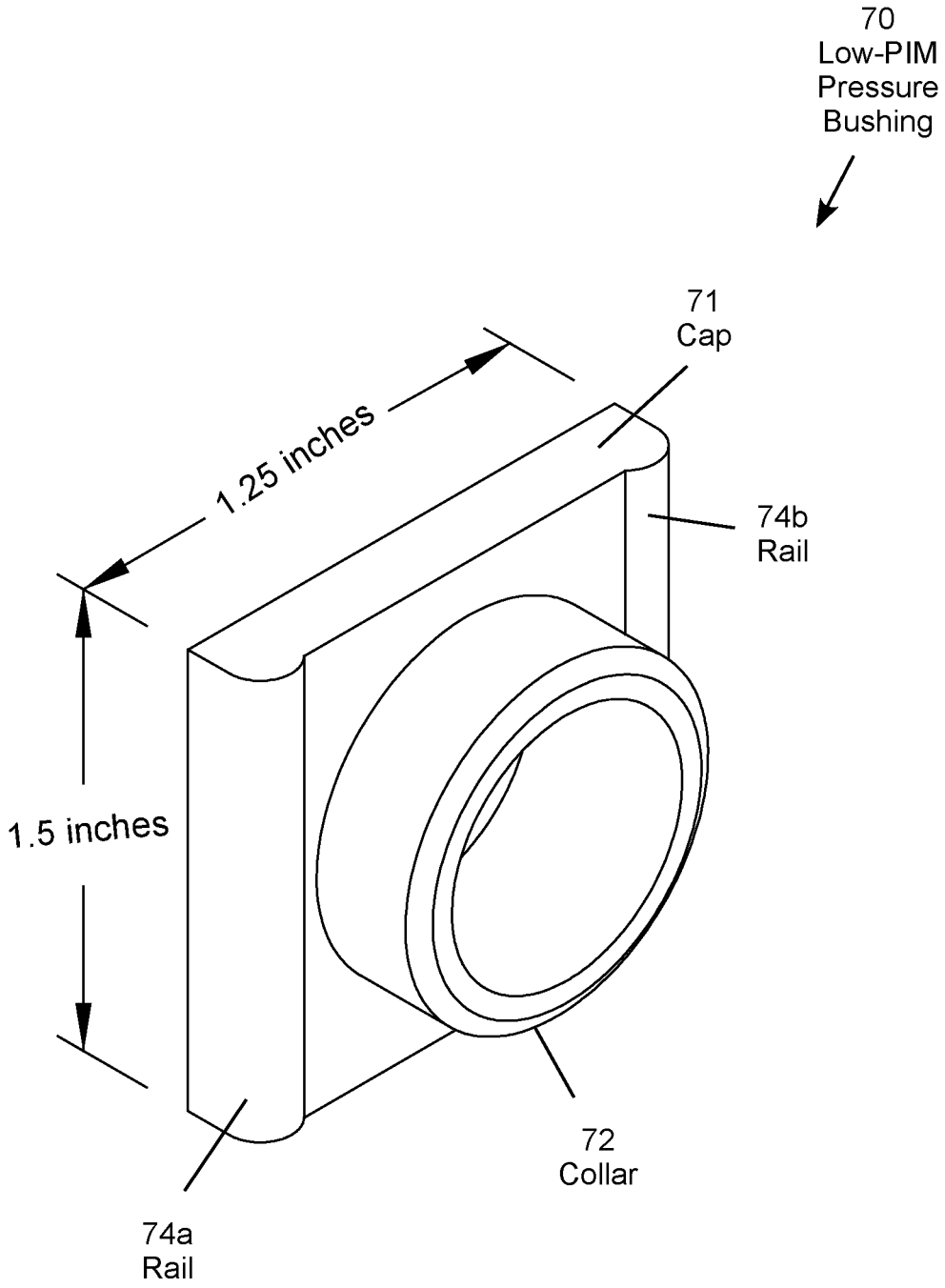
FIG. 7 is a perspective view of the low-PIM pressure bushing.

FIG. 7 is perspective view of an illustrative dimensioned embodiment of the pressure bushing 70 shown approximately to scale. The pressure bushing 70 includes a cap 71 and a collar 72 sized to fit into a receptacle hole in a support member, such as the vertical mast 11 in this particular embodiment. The cap 71 includes a pair of rails 74*a* and 74*b*, which are vertically oriented in this particular example, to stabilize the cap on the mast 11. As opposed to a curved cap, the rails 74*a* and 74*b* allow the same pressure bushing 70 to be used with masts having a range of diameters. The specific dimensions are representative and pertain to pressure bushing suitable for use with round cylindrical masts having a range of diameters from 2 inches to 6 inches. Other embodiments of the pressure bushing may not include parallel rails. For example, pressure bushings without rails may be used with masts that are not round or curved, such as brackets and other flat support members. Accordingly, the term "mast" is not limited to vertical or round support members.

As explained previously, embodiments the pressure bushing 70 may be manufactured from a polymeric material, such as glass-filled Nylon, or a metallic material, such as cast or machined aluminum. An illustrative embodiment of the pressure bushing 70 may be glass-filled Nylon. An aluminum pressure bushing 70 is suitable for use with a galvanized steel mast when the attachment pressure on the bushing is sufficiently high and the galvanic properties of the bushing and mast materials are sufficiently close to each other to ensure that the connection will exhibit the desired low-PIM characteristic when the universal mount is located in the reactive nearfield region of an associated antenna. In particular, the connection pressure should be sufficiently high to prevent the pressure bushing 70 from physically moving with respect to the mast under the expected mechanical load conditions. Other types of metal may be used for the pressure bushing provided that the connection exhibits the desired low-PIM characteristic when the mount is located in the reactive nearfield region of the associated antenna. A metal pressure bushing may be suitable for use with a bolt or threaded rod that is galvanized steel like the mast and brackets. With the polymeric pressure bushing, the mast and brackets may be either galvanized or stainless hardware since the metals are insulated by the polymeric pressure bushing.

While particular aspects of the present subject matter have been shown and described in detail, it will be apparent to those skilled in the art that, based upon the teachings of this disclosure, changes and modifications may be made without departing from the subject matter described in this disclosure and its broader aspects and, therefore, the appended claims are to encompass within their scope all such changes and modifications as are within the true spirit and scope of the subject matter described in this disclosure. Although particular embodiments of this disclosure have been illustrated, it is apparent that various modifications and embodiments of the disclosure may be made by those skilled in the art without departing from the scope and spirit of the disclosure.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. The disclosure is defined by the following claims, which should be construed to encompass one or more structures or function of one or more of the illustrative embodiments described above, equivalents and obvious variations. It will therefore be appreciated that the present invention provides significant improvements. The foregoing relates only to the exemplary embodiments of the present invention, and that numerous changes may be made therein without departing from the spirit and scope of the invention as defined by the following claims.

The invention claimed is:

1. A low-PIM universal antenna equipment mount comprising:

a metal mast;

at least one pressure bushing comprising a cap and a collar received within a receptacle hole in the mast;

a metal bracket or platform supporting attached communications equipment connected to the mast by the pressure bushing;

wherein the pressure bushing is located within the reactive nearfield region of an antenna connected to or located near the mast; and wherein the pressure bushing suppresses generation of passive intermodulation interference (PIM) while supporting equipment and resisting environmental loads applied by the attached communications equipment.

2. The low-PIM universal antenna equipment mount of claim 1, wherein the pressure bushing comprises a pair of parallel rails configured to engage in low-PIM connections with round cylindrical masts having varying diameters within the range of 2 inches to 6 inches.

3. The low-PIM universal antenna equipment mount of claim 1, wherein the pressure bushing as manufactured from a polymeric material.

4. The low-PIM universal antenna equipment mount of claim 3, wherein the pressure bushing as manufactured from glass-filled Nylon.

5. The low-PIM universal antenna equipment mount of claim 1, wherein the pressure bushing as manufactured from a metallic material.

6. The low-PIM universal antenna equipment mount of claim 5, wherein the pressure bushing as manufactured from cast or machined aluminum.

7. The low-PIM universal antenna equipment mount of claim 1, wherein the attached communications equipment comprises a platform, an accessory bracket, a cable bracket, or an antenna bracket.

8. The low-PIM universal antenna equipment mount of claim 1, wherein the attached communications equipment comprises a cable block.

9. The low-PIM universal antenna equipment mount of claim 1, further comprising a bolt or threaded rod extending through the pressure bushing and the mast, a fender washer, and a nut threaded on the bolt or threaded rod capturing the pressure bushing between the fender washer and the mast.

10. The low-PIM universal antenna equipment mount of claim 1, wherein the bolt or threaded rod extends through the mast in alignment with a neutral axis of the mast orthogonal to an axis of main physical load supported by the mast.

11. The low-PIM universal antenna equipment mount of claim 1, wherein the reactive nearfield region is limited to one carrier frequency wavelength of a radio signal communicated by the antenna.

12. A low-PIM antenna equipment mount assembly comprising:

a metal mast;

a pair of pressure bushings, each comprising a cap and a collar received within a receptacle hole in the mast, the pressure bushings coaxially aligned with each other across the mast and aligned with a neutral axis of the mast orthogonal to an axis of main physical load supported by the mast;

a bolt or threaded rod extending through the pressure bushings and the mast, a pair of fender washers, and a pair of nuts threaded on the bolt or threaded rod, wherein each pressure bushing is captured between an associated fender washer and the mast by an associated nut;

a metal dual transverse bracket attached to the threaded rod supporting communications equipment on opposing sides of the mast aligned orthogonally to the threaded rod or bolt;

wherein each pressure bushing is located within the reactive nearfield region of an antenna supported by the dual transverse bracket; and wherein each pressure bushing suppresses generation of passive intermodulation interference (PIM) while supporting equipment and resisting environmental loads applied by the antenna.

13. The low-PIM antenna equipment mount assembly of claim 12, wherein each pressure bushing comprises a pair of parallel rails configured to engage in low-PIM connections with round cylindrical masts having varying diameters within the range of 2 inches to 6 inches.

14. The low-PIM antenna equipment mount assembly of claim 12, further comprising a communications equipment accessory attached to the dual transverse antenna mount on an opposing side of the mast from the antenna.

15. The low-PIM antenna equipment mount assembly of claim 12, wherein the antenna is a first antenna, further comprising a second antenna attached to the dual transverse antenna mount on an opposing side of the mast from the first antenna.

16. The low-PIM antenna equipment mount assembly of claim 15, wherein the reactive nearfield region is limited to one carrier frequency wavelength of radio signals communicated by the first and second antennas.

17. A low-PIM antenna equipment mount assembly comprising:

a metal mast;

a plurality of pressure bushings, each comprising a cap and a collar received within a receptacle hole in the mast, the pressure bushings arranged in pairs of pressure bushings coaxially aligned with each other across the mast and aligned with a neutral axis of the mast orthogonal to an axis of main physical load supported by the mast;

each cap comprising a pair of parallel rails disposed against the mast;

a bolt or threaded rod extending through each pair of pressure bushings and the mast, a pair of fender washers, and a pair of nuts threaded on the bolt or threaded rod, wherein each pressure bushing is captured between an associated fender washer and the mast by an associated nut;

an antenna connected to the mast on a first side of the mast by one or more brackets attached to the mast by one or of the bolts or threaded rods;

one or more pieces of communications equipment connected to the mast on a second side of the mast opposing the first side by one or more metal brackets attached to the mast by one or of the bolts or threaded rods;

wherein each pressure bushing is located within the reactive nearfield region of the antenna; and wherein each pressure bushing suppresses generation of passive intermodulation interference (PIM) while supporting equipment and resisting environmental loads applied by the antenna or the pieces of communications equipment.

18. The low-PIM antenna equipment mount assembly of claim 12, wherein each pressure bushing comprises a pair of parallel rails configured to engage in low-PIM connections with round cylindrical masts having varying diameters within the range of 2 inches to 6 inches.

19. The low-PIM antenna equipment mount assembly of claim 17, wherein the pieces of communications equipment comprise one or more accessory mounts supporting a radio operatively connected to the antenna, an RF cable extending form the radio to the antenna, and a cable bracket supporting the cable.

20. The low-PIM antenna equipment mount assembly of claim 17, further comprising a tilt bracket connecting an upper portion of the antenna to the mast by one or of the bolts or threaded rods.

* * * * *